US007565103B2

(12) United States Patent
Chae et al.

(10) Patent No.: US 7,565,103 B2
(45) Date of Patent: Jul. 21, 2009

(54) DEVICE FOR FUSING TONER ON PRINT MEDIUM

(75) Inventors: Young-min Chae, Suwon-si (KR); Joong-gi Kwon, Gunpo-si (KR); Hwan-guem Kim, Seoul (KR); Durk-hyun Cho, Suwon-si (KR); Sang-yong Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 299 days.

(21) Appl. No.: 11/214,881

(22) Filed: Aug. 31, 2005

(65) Prior Publication Data

US 2006/0045591 A1 Mar. 2, 2006

(30) Foreign Application Priority Data

Sep. 1, 2004 (KR) ..... 10-2004-0069561

(51) Int. Cl.
*G03G 15/20* (2006.01)

(52) U.S. Cl. ..... 399/334; 399/328; 399/330

(58) Field of Classification Search ..... 399/328, 399/330

See application file for complete search history.

(56) References Cited

U.S. PATENT DOCUMENTS 6,049,691 A * 4/2000 Abe et al. ..... 399/330
6,587,654 B1 * 7/2003 Nishi ..... 399/328
2002/0125244 A1 * 9/2002 Yokozeki et al. ..... 399/330
2003/0042241 A1 * 3/2003 Uekawa et al. ..... 219/216
2004/0101335 A1 * 5/2004 Cho et al. ..... 399/330

FOREIGN PATENT DOCUMENTS

| | | |
|---|---|---|
| JP | 58-106583 | 6/1983 |
| JP | 62-289878 | 12/1987 |
| JP | 06-035366 | 2/1994 |
| JP | 09-297494 | 11/1997 |
| JP | 2001-272897 | 10/2001 |
| JP | 2001-318545 | 11/2001 |
| KR | 1993-012318 | 7/1993 |
| KR | 1997-032271 | 6/1997 |

* cited by examiner

*Primary Examiner*—David M Gray
*Assistant Examiner*—Ryan D Walsh
(74) *Attorney, Agent, or Firm*—Roylance, Abrams, Berdo and Goodman, LLP

(57) ABSTRACT

A fusing device for fusing a predetermined toner image on paper, and which controls the heating range of a fusing unit by inputting an eddy current generated by a transformer to a terminal corresponding to the size of paper selected from a plurality of terminals of the fusing unit. The fusing device includes a power supply unit to which a predetermined alternating current is input and which generates an induced current in response to the input alternating current, a fusing unit being resistance-heated and induction-heated by the induced current and fusing the toner image on the paper using the generated heat, and a controller for controlling the induced current supplied to the fusing unit according to the size of the paper.

38 Claims, 6 Drawing Sheets

DEVICE FOR FUSING TONER ON PRINT MEDIUM

CROSS-REFERENCE TO RELATED PATENT APPLICATIONS

This application claims the benefit under 35 U.S.C. §119 (a) of Korean Patent Application No. 10-2004-0069561, filed in the Korean Intellectual Property Office on Sep. 1, 2004, the entire disclosure of which is incorporated herein by reference.

BACKGROUND OF THE INVENTION

1. Field of the Invention

The present invention relates to a device for fusing a predetermined toner image on paper. More particularly, the present invention relates to a fusing device which controls the heating range of a fusing unit by inputting an eddy current generated by a transformer to a terminal corresponding to the size of paper selected from a plurality of terminals of the fusing unit.

2. Description of the Related Art

A conventional image printing apparatus comprises a fusing device which applies a predetermined pressure and amount of heat to a toner so as to fuse a predetermined toner image on paper. The fusing device includes a fusing unit which applies a predetermined amount of heat to the toner, and a pressurizer which applies predetermined pressure to the toner. The fusing unit includes a heater which generates heat used to fuse a toner image on the paper, and a toner fusing layer which transfers heat generated by the heating body onto the paper.

FIG. 1 is a schematic cross-sectional view taken along a lateral plane through a conventional fusing unit 10 of a fusing device using a halogen lamp as a heat source. Referring to FIG. 1, the fusing unit 10 comprises a fusing roller 11 and a heating body 12, which is comprised of a halogen lamp installed in the center of the fusing unit 10. A coating layer 11*a* made of Teflon is formed on the surface of the fusing roller 11. The heating body 12 generates heat, and the fusing roller 11 is heated by radiant heat transferred from the heating body 12.

The fusing unit 10 of FIG. 1 is used to apply heat to a sheet of paper. There are many types of papers, such as A4, A5, B5, and so forth, used in an image printing apparatus. Recently, many types of photo paper sizes, such as 3×4, 3×5, and 5×7 inches, have also been provided for directly printing photos using the image printing apparatus. However, a conventional image printing apparatus heats the entire surface of a fusing roller regardless of the size of paper to be printed. Thus, when a toner image is printed on paper having a smaller size than that of the fusing roller, there is a large temperature difference created between a region in which the paper passes through the fusing roller, and a region in which the paper does not pass through the fusing roller. When the image printing apparatus is used over a long period of time, the image printing apparatus may malfunction due to the rapid temperature increase in the region in which the paper does not pass through the fusing roller. In addition, due to uneven heating of the fusing roller, the life span of the image printing apparatus is reduced.

Additionally, in a conventional fusing unit using a halogen lamp as a heat source, a warm-up time of several seconds to several minutes is required for the unit to reach a target fusing temperature after energy is supplied to the fusing unit. Thus, a user is required to wait for a long warm-up time when printing an image, regardless of the paper size.

Accordingly, a need exists for a system and method for more efficiently and quickly heating a fusing unit by considering a paper size.

SUMMARY OF THE INVENTION

The present invention substantially solves the above and other problems and provides other advantages, and provides a fusing unit for locally heating a toner fusing layer corresponding to the size of paper within a short warm-up time by using a predetermined eddy current.

The present invention also provides a fusing unit for locally heating a toner fusing layer corresponding to a paper size within a short warm-up time by simultaneously using induction heating and resistance heating.

The present invention also provides a fusing device for locally heating a toner fusing layer of a toner fusing unit corresponding to a paper size within a short warm-up time by using an eddy current generated by a transformer.

The present invention also provides a fusing device for locally heating a toner fusing layer of a toner fusing unit corresponding to a paper size within a short warm-up time by simultaneously using induction heating and resistance heating.

According to an aspect of the present invention, a unit is provided for fusing a toner image on paper, the unit comprising a heater to which an induced current is input and which is resistance-heated, a terminal unit having at least three or more terminals for supplying the induced current to a region of the heater corresponding to the size of the paper, and a toner fusing layer for fusing the toner image on the paper by heat transferred from the region of the heater.

According to another aspect of the present invention, a unit is provided for fusing a toner image on paper, the unit comprising a heater being resistance-heated by a predetermined alternating current and generating an alternating magnetic flux by the alternating current, a terminal unit having at least three or more terminals for supplying the alternating current to a region of the heater corresponding to the size of the paper, and a toner fusing layer for generating an eddy-current in response to the alternating magnetic flux and being induction-heated by the eddy current.

According to still another aspect of the present invention, a device is provided for fusing a toner image on paper, the device comprising a power supply unit to which a predetermined alternating current is input and which generates an induced-current in response to the alternating current, a fusing unit being resistance-heated by the induced-current and fusing the toner image on the paper using the generated heat, and a controller for controlling the induced-current supplied to the fusing unit according to the size of the paper.

According to yet another aspect of the present invention, a device is provided for fusing a toner image on paper, the device comprising an alternating current generator for generating a predetermined alternating current, a fusing unit being resistance-heated and induction-heated by the alternating current and fusing the toner image on the paper using the generated heat, and a controller for controlling the alternating current supplied to the fusing unit according to the size of the paper.

BRIEF DESCRIPTION OF THE DRAWINGS

The above and other aspects and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF THE EXEMPLARY EMBODIMENTS

Figure 1:
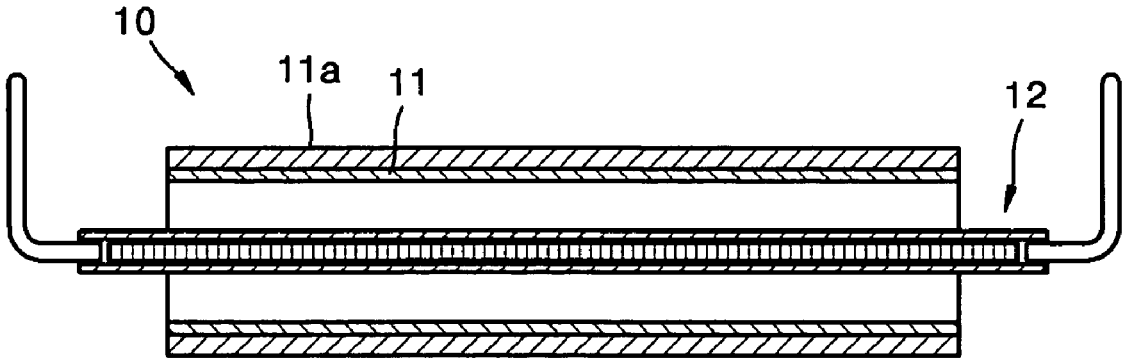
FIG. 1 (PRIOR ART)
FIG. 1 is a schematic cross-sectional view taken along a lateral plane through a conventional fusing unit of a fusing device using a halogen lamp as a heat source.
Figure 2:
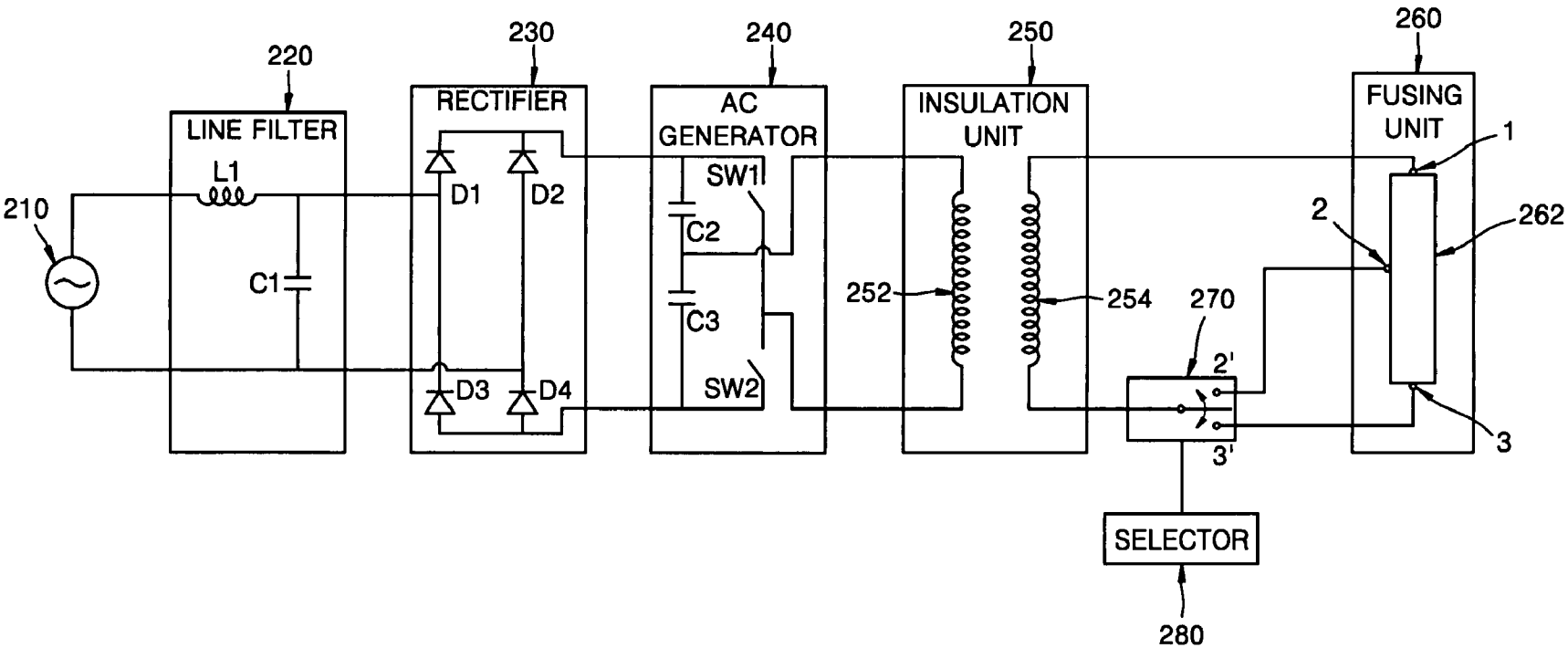
FIG. 2 is a functional block diagram of a fusing device according to an embodiment of the present invention.

FIG. 2 is a functional block diagram of a fusing device according to an embodiment of the present invention. Referring to FIG. 2, the fusing device comprises a power supply unit 210, a line filter 220, a rectifier 230, an AC generator 240, an insulation unit 250, a fusing unit 260 having a heater 262, a controller 270, and a selector 280. The power supply unit 210 supplies an AC signal having a predetermined amplitude and frequency. The line filter 220 includes an inductor L1 and a capacitor C1. The line filter 220 removes harmonics components included in the AC signal received from the power supply unit 210. The line filter 220 is illustrated as one type of a line filter for illustrating an exemplary embodiment of the present invention, and is not limited thereto. In yet other embodiments of the present invention, another type of line filter may be used as the line filter 220 without departing from the scope of the present invention.

The rectifier 230 generates a DC signal by rectifying the AC signal supplied by the line filter 220. The rectifier 230 is a bridge rectifier comprising four diodes D1, D2, D3, and D4, and rectifies the AC signal into the DC signal according to the polarities of the four diodes D1, D2, D3, and D4. In yet other embodiments of the present invention, another type of line rectifier may be used as the rectifier 230 without departing from the scope of the present invention.

The AC generator 240 generates an AC signal from the DC signal supplied by the rectifier 230. The AC generator 240 comprises two capacitors C2 and C3, and two switches SW1 and SW2, and converts the DC signal rectified by the rectifier 230 into the AC signal by selectively switching the switches SW1 and SW2 on and off. The AC generator 240 generates a high-frequency or low-frequency AC signal from the DC signal generated by the rectifier 230 according to an application of the fusing device. In yet other embodiments of the present invention, another type of AC generator may be used as the AC generator 240 without departing from the scope of the present invention.

The insulation unit 250 generates an induced-current from the AC signal generated by the AC generator 240, and supplies the generated induced-current to the heater 262. The heater 262 comprises a heating body (not shown), which is resistance-heated by the induced-current, and a thin insulating layer (not shown) for preventing the heating body and a toner fusing layer (not shown) of the fusing unit 260 from being shorted to each other.

Accordingly, the current input by the power supply unit 210 is not directly supplied to the heating body, but the induced-current generated using the insulation unit 250 is supplied to the heating body, such that the insulation unit 250 electrically insulates the power supply unit 210 from the heating body. Hereinafter, a high-frequency transformer having a smaller volume than that of a low-frequency transformer, will be described as an example of the insulation unit 250. In yet other embodiments of the present invention, another type of transformer may be used as the insulation unit 250 without departing from the scope of the present invention When an AC signal flows through a primary coil 252 of the transformer 250, a magnetic field around a secondary coil 254 changes, and an induced-current is generated in the secondary coil 254 by the changing magnetic field. The induced-current generated by the transformer 250 is supplied to the heater 262 of the fusing unit 260. The size of the induced-current can be controlled by a winding ratio of the primary coil 252 and the secondary coil 254. A current from the power supply unit 210 that flows through the primary coil 252 of the transformer 250 causes an induced-current in the secondary coil 254 of the transformer 250 by electromagnetic induction. The generated induced-current is supplied to the heater 262 of the fusing unit 260. Since the induced-current generated by the transformer 250 is supplied to the secondary coil 254 rather than the current of the power supply unit 210, the power supply unit 210 and a heating body (not shown) of the heater 262 are electrically insulated from each other. Thus, a thin insulating layer may be used for preventing the heating body and the toner fusing layer from being shorted to each other, as compared with conventional devices.

The fusing unit 260 is resistance-heated by the induced-current generated by the insulation unit 250. When the paper (not shown) passes through the fusing unit 260, the fusing unit 260 fuses a toner image on the paper using generated heat. The heater 262 of the fusing unit according to an embodiment of the present invention is comprised of a heating body and an insulating layer. The heater 262 is further comprised of a plurality of terminals 1, 2, and 3, to which the induced current is input, and wherein the plurality of terminals are connected to the heating body. The exemplary heater 262 shown in FIG. 2 includes the plurality of terminals 1, 2, and 3, but in yet other embodiments of the present invention, the heater 262 may comprise any number of terminals according to an application of the fusing device.

As noted above, the fusing device comprises a controller 270, and a selector 280. A user inputs a user's command for selecting a paper size to be printed by using the selector 280. The selector 280 may be a user interface comprised of a touch screen or a key panel unit having a plurality of manipulation keys.

The controller 270 controls the induced-current supplied to the heater 262 according to the size of the paper selected by the selector 280. The controller 270 is illustrated as one type of a switch. In yet other embodiments of the present invention, another type of controller may be used as the controller 270 without departing from the scope of the present invention.

When the entire surface of the toner fusing layer of the fusing unit 260 is required to print the paper selected by the selector 280, the switch 270 is switched to a contact point 3' connected to the third terminal 3 of the heater 262. Since the induced-current generated by the insulation unit 250 is always input to the first terminal 1, and in this case, also input to the third terminal 3, the entire surface of the heating body of the heater 262 is heated and the entire surface of the toner fusing layer is heated by heat generated in the heating body. When only a portion of the toner fusing layer of the fusing unit 260 is required to be heated so as to print the paper selected by the selector 280, the switch 270 is switched to a contact point 2' connected to the second terminal 2 of the heater 262. Since the induced-current generated by the insulation unit 250 is always input to the first terminal 1, and in this case, also input to the second terminal 2, only a portion of the heating body of the heater 262 is heated and only a portion of the toner fusing layer is heated by the heat generated in the heating body.

Figure 3A:
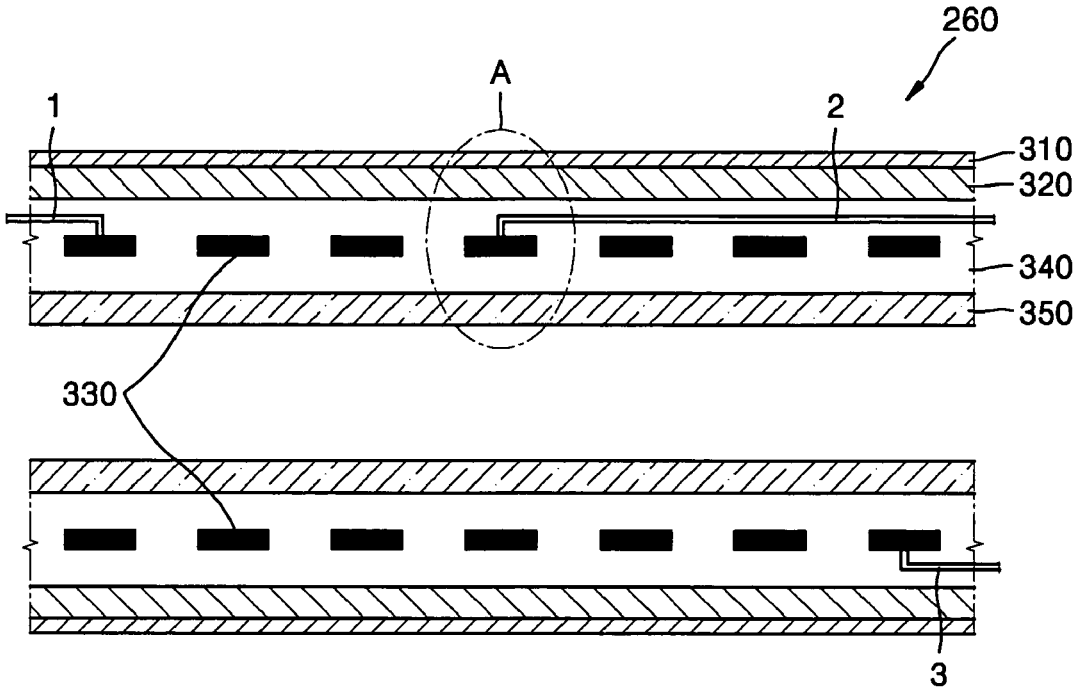
FIG. 3A is a cross-sectional view taken along a lateral plane through the fusing unit of FIG. 2.
Figure 3B:
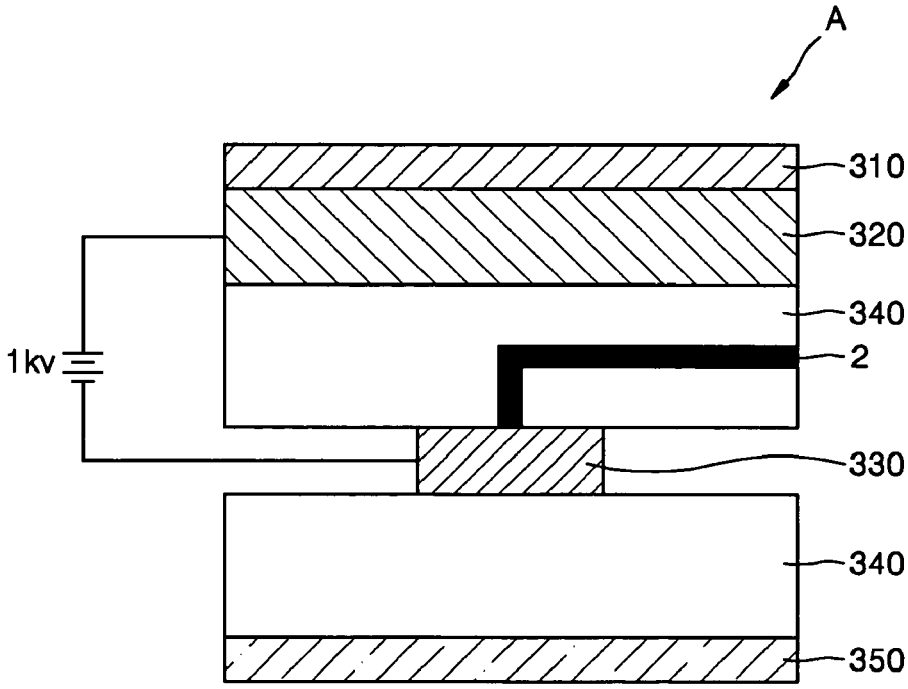
FIG. 3B is a detailed diagram of a heater of the fusing unit of FIG. 3A.

FIG. 3A is a cross-sectional view taken along a lateral plane through the heater 262 of the fusing unit 260 of FIG. 2, and FIG. 3B is a detailed diagram of a heater of the fusing unit of FIG. 3A. The heater 262 comprises a heating body 330 and an insulating layer 340 interposed between the heating body 330 and a toner fusing layer 320. A protective layer 310 coated with Teflon is formed on the surface of the toner fusing layer 320. The insulating layer 340 is used to prevent the heating body 330 and the toner fusing layer 320 from being electrically shorted to each other. A thin insulating layer for preventing only electrical shorts is inserted into the heating body 330 and the toner fusing layer 320. The insulating layer 340 may be formed of a material selected from the group consisting of mica, polyimide, ceramic, silicon, polyurethane, glass, and polytetrafluoruethylene (PTFE) materials. In yet other embodiments of the present invention, the insulating layer 340 may be formed of different materials according to the application of the fusing device without departing from the scope of the present invention. An exemplary withstand voltage value provided between the toner fusing layer 320 and the heating body 330 in this case may be equal to or less than 1 kV, as shown in FIG. 3B.

Three terminals 1, 2, and 3, are electrically connected to the heating body 330. A first terminal 1 and a third terminal 3 are directly connected to both ends of the heating body 330, and a second terminal 2 may be connected to the heating body 330 via the insulating layer 340. Since the toner fusing layer 320 may be formed of a conductive metal, the heating body 330 and the toner fusing layer 320 can be connected to each other at a predetermined position of the heating body 330 so that the toner fusing layer 320 can be used as the second terminal 2.

When the entire surface of the heating body 330 is to be heated, the induced-current generated by the insulation unit 250 is supplied to the first terminal 1 and the third terminal 3 through the switch 270. When only a portion of the heating body 330 is to be heated, the induced-current generated by the insulation unit 250 is supplied to the first terminal 1 and the second terminal 2 through the switch 270.

A fusing roller is illustrated as one type of toner fusing layer 320 in the heater 262 of the fusing unit 260 shown in FIG. 3A. However, in yet other embodiments of the present invention, another type of toner fusing layer may be used as the toner fusing layer 320 without departing from the scope of the present invention.

The heating body 330 may be comprised of a coil. In yet other embodiments of the present invention, another type of heating body may be used as the heating body 330 without departing from the scope of the present invention.

As the thickness of the insulating layer 340 inserted between the toner fusing layer 320 and the heating body 330 increases, heat generated in the heating body 330 is not effectively transferred to the toner fusing layer 320. Thus, as the thickness of the insulating layer 340 decreases, heat generated in the heating body 330 can be more effectively transferred to the toner fusing layer 320. In addition, a tube-expansion adhesion portion 350 is fixedly disposed within the heating body 330 and closely adheres the heating body 330 and the toner fusing layer 320 to each other, so that heat generated in the heating body 330 can be more effectively transferred to the toner fusing layer 320.

The induced-current is supplied to the terminals corresponding to the size of the paper selected by the selector 280, and which are selected from among a plurality of terminals 1, 2, and 3, connected to the heating body 330 so that the toner fusing layer 320 can be locally heated when needed.

Figure 4:
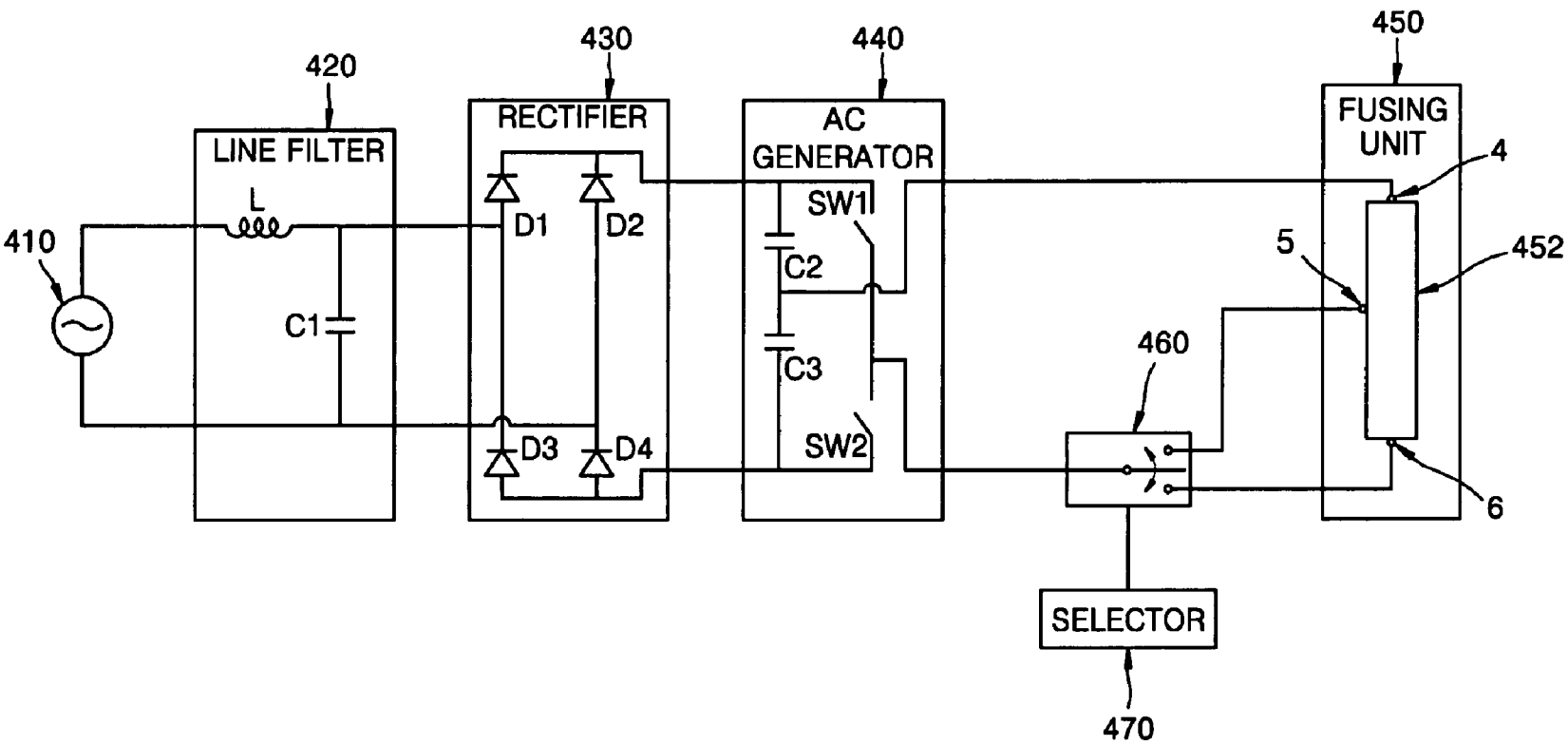
FIG. 4 is a functional block diagram of a fusing device according to another embodiment of the present invention.

FIG. 4 is a functional block diagram of a fusing device according to another embodiment of the present invention. Referring to FIG. 4, the fusing device comprises a power supply unit 410, a line filter 420, a rectifier 430, an AC generator 440, a fusing unit 450 having a heater 452, a controller 460, and a selector 470. The power supply unit 410, the line filter 420, the rectifier 430, the AC generator 440, the controller 460, and the selector 470 of FIG. 4 perform substantially the same functions as those of the power supply unit 210, the line filter 220, the rectifier 230, the AC generator 240, the controller 270, and the selector 280 of FIG. 2. Accordingly, a detailed description of each is omitted for clarity and conciseness.

The fusing unit 450 of FIG. 4 is resistance-heated and induction-heated by the AC signal generated by the AC generator 440. The fusing unit 450 fuses a toner image on the paper (not shown) using generated heat. The fusing unit 450 includes the heater 452. The heater 452 comprises an induction coil (not shown) and an insulating layer (not shown). The heater 452 further comprises a plurality of terminals 4, 5, and 6, to which the AC signal is input, and wherein the plurality of terminals 4, 5, and 6, are connected to the induction coil.

If the AC signal flows through the induction coil, the induction coil is resistance-heated by its electrical resistance and a variable alternating magnetic flux is generated in the induction coil. Due to the alternating magnetic flux, an eddy current is generated in a toner fusing layer (not shown) placed on an upper portion of the induction coil, and the toner fusing layer is induction-heated by the eddy current. Induction heating used to heat the toner fusing layer and resistance heating will be described in greater detail below with reference to FIG. 6.

The controller 460 supplies the AC signal to the terminals corresponding to the size of the paper selected by the selector 470 from among the plurality of terminals 4, 5, and 6, and the toner fusing unit is induction-heated and resistance-heated by the supplied AC signal.

Figure 5A:
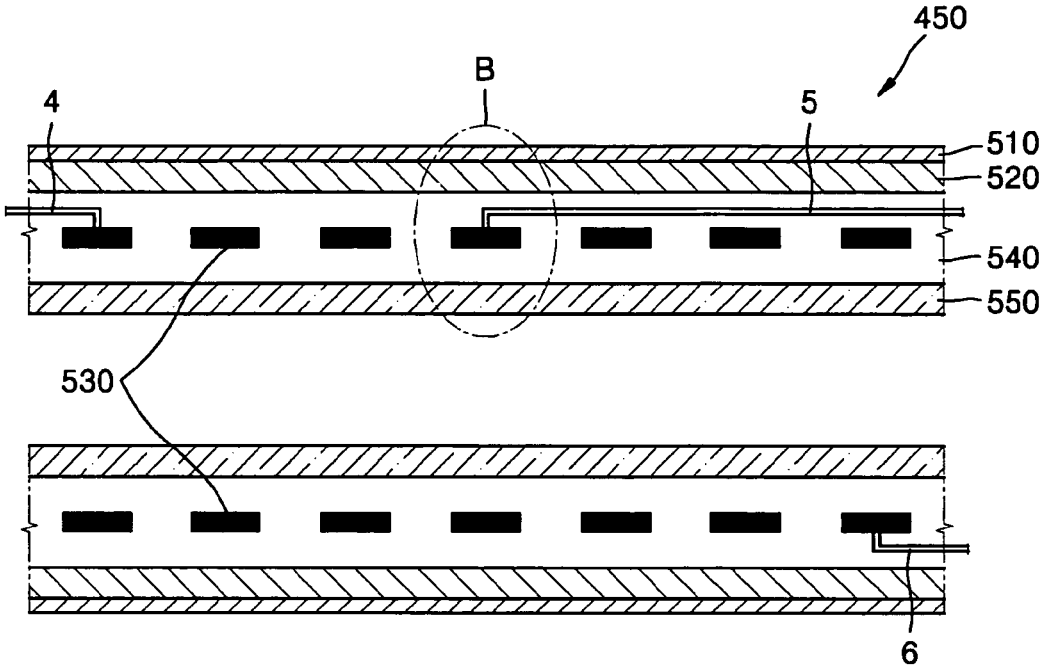
FIG. 5A is a cross-sectional view taken along a lateral plane through the fusing unit of FIG. 4.
Figure 5B:
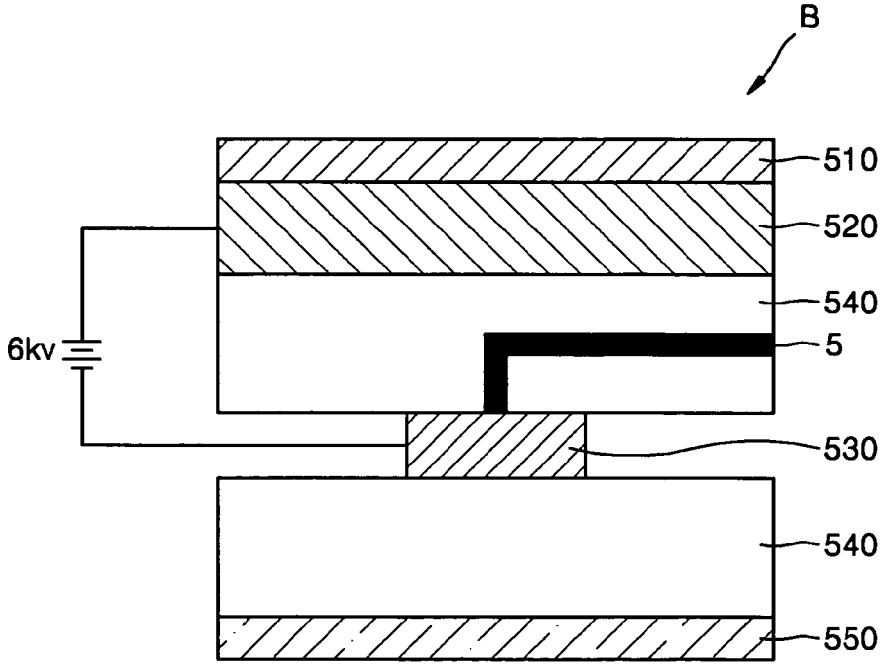
FIG. 5B is a detailed diagram of a heater of the fusing unit shown in FIG. 5A.

FIG. 5A is a cross-sectional view taken along a lateral plane through the heater 452 of the fusing unit 450 of FIG. 4, and FIG. 5B is a detailed diagram of a heater of the fusing unit shown in FIG. 5A.

The fusing unit 450 shown in FIG. 5A comprises a protective layer 510, a toner fusing layer 520, an induction coil 530, an insulating layer 540, an adhesion portion 550, and a plurality of terminals 4, 5, and 6. The protective layer 510, the toner fusing layer 520, the insulating layer 540, the adhesion portion 550, and the plurality of terminals 4, 5, and 6, of the fusing unit 450 of FIG. 5A perform substantially the same functions as those of the protective layer 310, the toner fusing layer 320, the adhesion unit 350, and the plurality of terminals 1, 2, and 3, of FIG. 3A. Accordingly, a detailed description of each is omitted for clarity and conciseness.

Since the AC signal generated in the AC generator 440 is directly input to the fusing unit 450 shown in FIG. 5A, the thick insulating layer 540 is provided so as to satisfy withstand voltage requirements between the coil 530 and the toner fusing layer 520. An exemplary withstand voltage value provided between the toner fusing layer 520 and the induction coil 530 in this case may be equal to or greater than 6 kV, as shown in FIG. 5B.

The coil 530 of the fusing unit 450 shown in FIG. 5A is resistance-heated by the AC signal input from the AC generator 440. A variable alternating magnetic flux is generated in the induction coil by the AC signal. An eddy current is generated in the toner fusing layer 520 in response to the generated alternating magnetic flux, and the toner fusing layer 520 is induction-heated by the eddy current. The induction coil 530 may be formed of copper or similar material. In yet other embodiments of the present invention, the induction coil 530 may be formed of any number of different materials according to the application of the fusing device without departing from the scope of the present invention.

Figure 6:
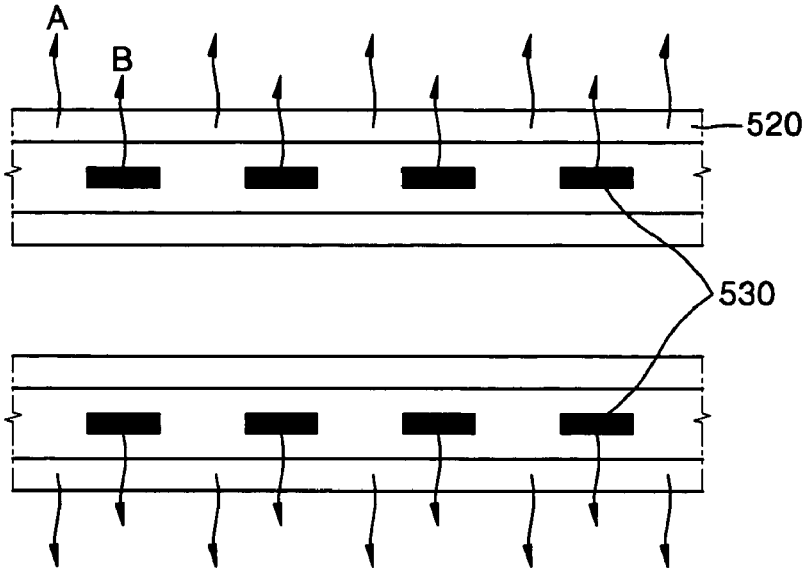
FIG. 6 is a view illustrating a heating source for heating the toner fusing layer of the fusing unit shown in FIGS. 5A and 5B according to an embodiment of the present invention.

FIG. 6 is a view illustrating a heating source for heating the toner fusing layer 520 of the fusing unit shown in FIGS. 5A and 5B according to an embodiment of the present invention. The toner fusing layer 520 of the fusing unit of the fusing device according to embodiments of the present invention is heated by induction heating and/or resistance heating. Specifically, an alternating magnetic flux that crosses with the toner fusing layer 520 is generated according to the AC signal that flows through the induction coil 530. The variable alternating magnetic flux that crosses with the toner fusing layer 520 results in the eddy current in the toner fusing layer 520. The eddy-current flows through the toner fusing layer 520 having an electrical resistance, so that heat is generated in the toner fusing layer 520. Heat generated by the eddy-current is induction heat, and is indicated by arrows A shown in FIG. 6.

The induction coil 530 also has an electrical resistance. Thus, when a predetermined AC signal is input to the induction coil 530, heat corresponding to the resistance of the induction coil 530 is generated. Heat generated by the resistance of the induction coil 530 is resistance heat, and is indicated by arrows B shown in FIG. 6.

Since the toner fusing layer 520 of the fusing unit according to embodiments of the present invention is simultaneously heated by using resistance heating generated in the induction coil 530, and by induction heating generated in the toner fusing layer 520, the fusing unit using induction heating has a shorter warm-up time than the fusing unit using only resistance heating, in which, Joule heat generated in the resistance coil inside the toner fusing portion is transferred to the toner fusing unit via the insulating layer.

The ratio of induction heat and resistance heat in a total amount of heat of the toner fusing unit can be adjusted according to the materials used for the induction coil 530, the number of turns of the induction coil 530, the materials used for the toner fusing layer 520, and a frequency of the AC signal applied to the induction coil 530, without departing from the scope of the present invention. For example, in the fusing device comprising coils made of copper and the toner fusing layer made of iron, when an AC signal having a voltage of 220 V, power of 1.2 kW, and frequency of 4.5 kHz, is input to the induction coil 530, it takes 20 seconds to heat the toner fusing layer 520 to a target fusing temperature of 180° C. When an AC signal having a voltage of 220 V, power of 1.2 kW, and frequency of 130 kHz, is input to the induction coil 530, it takes 12 seconds to heat the toner fusing layer 520 to the target fusing temperature of 180° C.

Figure 7:
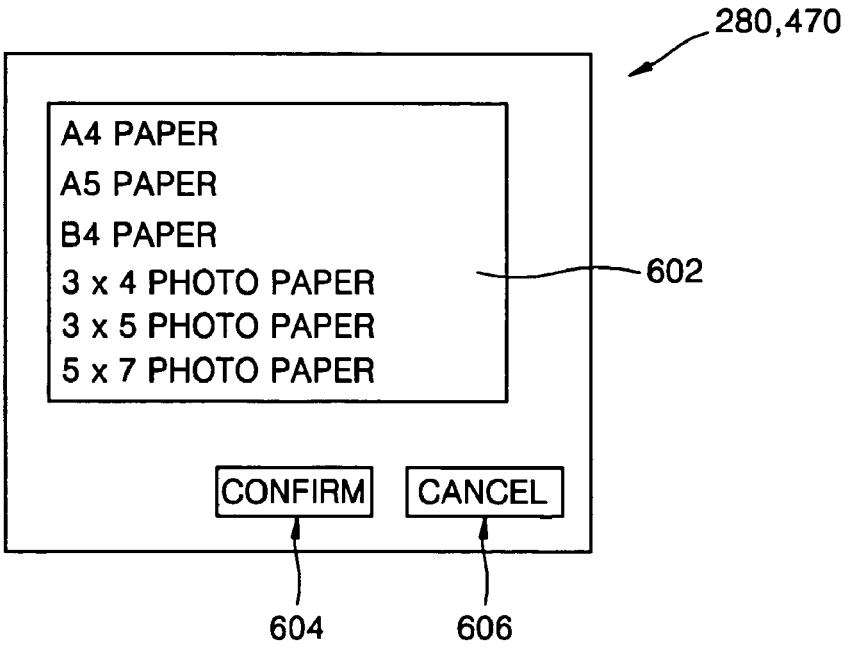
FIG. 7 is a view illustrating an example of selectors for selecting paper in the fusing device shown in FIGS. 2 and 4 according to an embodiment of the present invention.

FIG. 7 is a view illustrating an example of the selectors 280 and 470 used in the fusing devices shown in FIGS. 2 and 4 according to an embodiment of the present invention. As noted above, the fusing unit is used to apply heat to a sheet of paper, and there are many types and sizes of paper used in such an image printing apparatus. Several types of paper which a user can select, for example, A4 paper, A5 paper, and B5 paper, and 3×4 photo paper, 3×5 photo paper, and 5×7 photo paper, are displayed on a display 602 of the selectors 280 and 470. The user selects a paper size to be printed by using confirm and cancel buttons 604 and 606, respectively, provided on the selectors 280 and 470. The selectors 280 and 470 then generate a paper selection signal corresponding to the selected paper, and supplies the generated paper selection signal to the controllers 270 and 460.

As described above, in the fusing device according to embodiments of the present invention, only the portion, or region of the toner fusing layer of the fusing unit through which the paper passes, is heated according to the size of the paper selected by the selector. Thus, in the fusing device according to embodiments of the present invention, an image printing apparatus is prevented from malfunctioning by a rapid temperature increase in a region in which the paper does not pass, and the life span of the image printing apparatus is extended by preventing uneven heating of the toner fusing unit.

In the fusing device according to embodiments of the present invention, since the power supply unit and the heater are electrically insulated from each other using the transformer, the fusing device comprises a fusing unit having a thin insulating layer. Thus, the toner fusing unit can be heated to the target fusing temperature more quickly and efficiently. Additionally, the heater may comprise any number of terminals at specific positions according to an application of the fusing device to provide greater flexibility as to which portion of the fuser is heated, as well as providing more efficient heating.

In the fusing device according to embodiments of the present invention, since the toner fusing unit is simultaneously heated by using induction heating and resistance heating, the toner fusing unit can be locally heated more quickly to the target fusing temperature.

While the invention has been particularly shown and described with reference to exemplary embodiments thereof, it will be understood by those skilled in the art that various changes in form and details may be made therein without departing from the spirit and scope of the invention as defined by the appended claims.

What is claimed is:

1. A unit for fusing a toner image on paper, the unit comprising:

a single continuous heater comprising multiple, selectable terminals and spanning multiple, selectable heating regions and to which an induced current is input and which is resistance-heated;

a selector having three or more terminals for selectively supplying the induced current of a single circuit to a region of the heater corresponding to a size of a paper; and a toner fusing layer for fusing a toner image on the paper by heat transferred from the region of the heater.

2. The unit of claim 1, wherein the heater comprises:

a heating body to which the induced current is input through the selector and which is resistance-heated; and an insulating layer for preventing the heating body and the toner fusing layer from being electrically shorted to each other.

3. The unit of claim 2, wherein the insulating layer is configured to provide a withstand voltage that is equal to or less than 1 kV.

4. The unit of claim 1, wherein the heating body is comprised of a coil.

5. The unit of claim 1, further comprising an adhesion portion for closely adhering the heater with the toner fusing layer.

6. The unit of claim 5, wherein the toner fusing layer is comprised of a fusing roller.

7. The unit of claim 6, wherein the heater and the toner fusing layer are rotated together.

8. A unit for fusing a toner image on paper, the unit comprising:

a single continuous heater comprising multiple, selectable terminals and spanning multiple, selectable heating regions and being resistance-heated by a predetermined alternating current and generating an alternating magnetic flux in response to the alternating current;

a selector having three or more terminals for selectively supplying the alternating current of a single circuit to a region of the heater corresponding to a size of a paper; and a toner fusing layer for generating an eddy-current in response to the alternating magnetic flux and being induction-heated by the eddy current.

9. The unit of claim 8, wherein the heater comprises:

a coil being resistance-heated by receiving the alternating current and generating an alternating magnetic flux in response to the alternating current; and an insulating layer for insulating the coil and the toner fusing layer from each other.

10. The unit of claim 9, wherein the ratio of resistance heating generated in the coil and induction heating generated in the unit is substantially determined by at least one of a material used for the coil, a frequency of the alternating current, and a material used for the toner fusing unit.

11. The unit of claim 10, wherein the coil is comprised of a copper alloy.

12. The unit of claim 10, wherein the alternating current is comprised of a high-frequency alternating current.

13. The unit of claim 9, further comprising an adhesion portion for closely adhering the heater with the toner fusing layer.

14. The unit of claim 13, wherein the adhesion portion is comprised of a tube-expansion adhesion portion for closely adhering the coil portion to the toner fusing layer using a predetermined tube-expansion pressure.

15. The unit of claim 13, wherein the toner fusing layer is comprised of a fusing roller.

16. The unit of claim 15, wherein the heater and the toner fusing layer are rotated together.

17. A device for fusing a toner image on paper, the device comprising:

a power supply unit to which a predetermined alternating current is input and which generates an induced-current in response to the alternating current;

a fusing unit having a single continuous heater comprising multiple, selectable terminals and spanning multiple, selectable heating regions and being resistance-heated by the induced-current and fusing a toner image on a paper using the generated heat; and a controller for controlling the induced-current of a single circuit supplied to a selected terminal of the continuous heater of the fusing unit according to a size of the paper.

18. The device of claim 17, further comprising a selector for selecting the size of the paper for the variable terminal selection by the controller.

19. The device of claim 17, wherein the power supply unit comprises:

a power supply unit for supplying a predetermined alternating current;

a rectifier for generating a direct current by receiving the predetermined alternating current;

an alternating current generator for generating an alternating current using the direct current; and an insulation unit to which the alternating current is input and which generates the induced-current in response to the alternating current.

20. The device of claim 19, wherein insulation unit is configured to electrically insulate the power supply unit from the fusing unit.

21. The device of claim 20, wherein the insulating unit is comprised of a transformer.

22. The device of claim 21, wherein the alternating current generator is configured to generate a high-frequency alternating current and the transformer is a high-frequency transformer.

23. The device of claim 17, wherein the fusing unit comprises:

the continuous heater spanning multiple, selectable heating regions and to which the induced-current is input and which is resistance-heated;

a selector having three or more terminals for supplying the induced-current to a region of the heater corresponding to a size of the paper as directed by the controller; and a toner fusing layer for fusing the toner image on the paper by heat transferred from the region of the heater.

24. The device of claim 23, wherein the heater comprises:

a heating body to which the induced-current is input through the selector and which is resistance-heated; and an insulating layer for preventing the heating body and the toner fusing layer from being electrically shorted to each other.

25. The device of claim 24, wherein the insulating layer is configured to provide a withstand voltage that is equal to or less than 1 kV.

26. The device of claim 24, wherein the heating body is comprised of a coil.

27. The device of claim 26, wherein the coil is configured to generate an alternating magnetic flux in the toner fusing layer in response to the induced-current, wherein the alternating magnetic flux causes an eddy current in the toner fusing layer.

28. The device of claim 27, wherein the toner fusing layer is configured to be heated by resistance heating generated in the coil by the induced-current and by induction heating generated in the toner fusing layer by the eddy current.

29. The device of claim 23, further comprising an adhesion portion for closely adhering the heater with the toner fusing layer.

30. The device of claim 29, wherein the toner fusing layer is comprised of a fusing roller.

31. The device of claim 30, wherein the fusing roller is rotated together with the heater.

32. A device for fusing a toner image on paper, the device comprising:

an alternating current generator for generating a predetermined alternating current;

a fusing unit having a single continuous heater comprising multiple, selectable terminals and spanning multiple, selectable heating regions and being resistance-heated and induction-heated by the alternating current and fusing a toner image on a paper using the generated heat; and a controller for controlling the alternating current of a single circuit supplied to a selected terminal of the continuous heater of the fusing unit according to a size of the paper.

33. The device of claim 32, wherein the alternating current generator is configured to generate a high-frequency alternating current.

34. The device of claim 32, wherein the fusing unit comprises:

the continuous heater spanning multiple, selectable heating regions and being resistance-heated by a predetermined alternating current and generating an alternating magnetic flux in response to the alternating current;

a selector having three or more terminals for supplying the alternating current to a region of the heater corresponding to a size of the paper as directed by the controller; and a toner fusing layer for generating an eddy current in response to the alternating magnetic flux and being induction-heated by the generated eddy current.

35. The device of claim 34, wherein the heater comprises:

a coil being resistance-heated by the alternating current and generating an alternating magnetic flux in response to the alternating current; and an insulating layer being interposed between the coil and the toner fusing layer, wherein the coil is comprised of a copper material.

36. The device of claim 34, wherein the fusing unit further comprises an adhesion portion for closely adhering the heater with the toner fusing layer.

37. The device of claim 36, wherein the toner fusing layer is comprised of a fusing roller.

38. The device of claim 37, wherein the fusing roller is rotated together with the heater.

* * * * *